US007954525B2

(12) United States Patent
Waterman

(10) Patent No.: US 7,954,525 B2
(45) Date of Patent: Jun. 7, 2011

(54) PORTABLE CROZER FOR BARRELS

(75) Inventor: Breck Waterman, Keswick (AU)

(73) Assignee: Southern Cross Cooperage Pty Ltd, Keswick, South Australia (AU)

( * ) Notice: Subject to any disclaimer, the term of this patent is extended or adjusted under 35 U.S.C. 154(b) by 131 days.

(21) Appl. No.: 12/271,240

(22) Filed: Nov. 14, 2008

(65) Prior Publication Data

US 2009/0126831 A1 May 21, 2009

(51) Int. Cl.
*B27H 5/08* (2006.01)

(52) U.S. Cl. ..... 147/13

(58) Field of Classification Search ..... 147/13
See application file for complete search history.

(56) References Cited

U.S. PATENT DOCUMENTS 1,799,840 A * 4/1931 Beugler ..... 147/13
1,930,822 A * 10/1933 Newhouse ..... 147/13
2,163,345 A * 6/1939 McMahon et al. ..... 147/13

* cited by examiner

*Primary Examiner* — Mark Rosenbaum
(74) *Attorney, Agent, or Firm* — Bio Intellectual Property Services LLC; O. M. (Sam) Zaghmout

(57) ABSTRACT

The present invention relates to a portable crozer adapted to be mounted above a new or used barrel for firstly creating a groove or "croze" along an inside surface to accommodate a barrel head, and secondly, for creating a bevelled top edge. In the case of used barrels, the croze is formed a short distance below the existing croze, and a new bevelled edge is formed to compensate for the lowered barrel head position. Conventional crozers are not adapted to be used on used barrels and have a number of inherent problems which are overcome by the present invention. In particular, conventional crozers are not portable which means they are not able to be used in mobile barrel reconditioning services, the time taken for each croze is significant, and they are generally in the form of bulky, quite expensive machinery.

17 Claims, 5 Drawing Sheets

PORTABLE CROZER FOR BARRELS

The present invention relates to a portable crozer for barrels and, in particular, to an apparatus for creating an inside groove, or "croze", adjacent the end of the barrel for accommodating a barrel head, and for bevelling the end of the barrel staves. The invention is intended for particular use on wine barrels, however, is not intended to be limited to such use.

BACKGROUND OF THE INVENTION

When manufacturing new barrels, or when reconditioning used barrels, a new inside croze is required at each barrel end for accommodating the barrel heads. A machine typically used to create this receiving groove is known as a crozer. The barrel will typically be in shell-form when sent to the crozer, comprising a plurality of staves temporarily secured together by heavy iron rings.

The crozer is used to cut the shell to a desired length, bevels the inner surfaces of the stave ends, and cuts certain grooves therein adjacent each of the two ends. Each groove is adapted to receive and hold a head of the barrel. After crozing, the rings adjacent the ends of the barrel are loosened, heads placed inside the grooves, and secured by tightening the rings. The exterior of the barrel is then turned or otherwise finished and the rings replaced with the usual metal hoops.

Existing crozers are large, often quite expensive machines. Such crozers, due to their size, are not intended to be portable, and require barrel shells to be transported to the machine for placement on a cradle to undergo cutting and bevelling. Existing crozing and bevelling techniques are also typically quite slow and cumbersome.

The applicant is the owner of a number of co-pending patent applications relating to barrel manufacture and reconditioning apparatus and methods, some of which are expressly incorporated by reference herein. One of these applications relates to a mobile system for reconditioning used barrels, and this is but one example where a conventional crozer is not suitable for use. The applicant has therefore recognised the need for a portable cutting and bevelling apparatus configured for use during the manufacture of new barrels, as well as during reconditioning of used barrels.

It is an object of the present invention to overcome this problem or to at least provide the public with a useful alternative.

SUMMARY OF THE INVENTION

In one form of the invention there is proposed a crozer for barrels including:

- a mounting means for securing said crozer to an end of said barrel;
- at least a first cutting means rotatably associated with said mounting means, said cutting means configured to form a groove along an inside surface of said barrel adjacent the end, said groove adapted to accommodate a barrel head.

Preferably said crozer includes a second cutting means rotatably associated with said mounting means, said second cutting means configured to form an inwardly extending bevel along an edge of the barrel end.

In preference said first and second cutting means are mounted to a supporting frame which rotatably engages the crozer mounting means, said first and second cutting means extending at least partially inside the barrel.

In preference said mounting means is in the form of an annular clamp adapted to engage an outer surface of an upright barrel adjacent an upper end thereof, such that said clamp sits substantially horizontally on the barrel.

In preference said annular clamp includes an annular guide disposed thereabove, said annular guide extending in a parallel arrangement with said clamp.

Preferably said supporting frame includes a plurality of radially disposed rollers adapted to slideably engage the annular guide.

Preferably the upright barrel includes a central vertical axis and said first cutting means is in the form of a pointed blade extending outwardly therefrom.

Preferably the horizontal and vertical position of said pointed blade is adjustable to thereby allow for the height and depth of the internal groove to be selected.

Preferably the horizontal position of the outwardly extending pointed blade is adjustable by rotation of a spindle having a shaft associated therewith in threaded engagement with a moveable sub-frame which supports said pointed blade.

In preference said sub-frame also supports a driving means for the pointed blade.

In preference said driving means is an electric motor.

Preferably said second cutting means is in the form of a downwardly extending router which when brought into contact with the inside edge of the barrel end, forms said bevel.

Preferably the horizontal and vertical position of said router is adjustable.

In preference said router is powered by a driving means.

In preference said driving means is an electric motor.

BRIEF DESCRIPTION OF THE DRAWINGS

The accompanying drawings, which are incorporated in and constitute a part of this specification, illustrate several implementations of the invention and, together with the description, serve to explain the advantages and principles of the invention. In the drawings.

DESCRIPTION OF THE PREFERRED EMBODIMENTS

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

Figure 1:
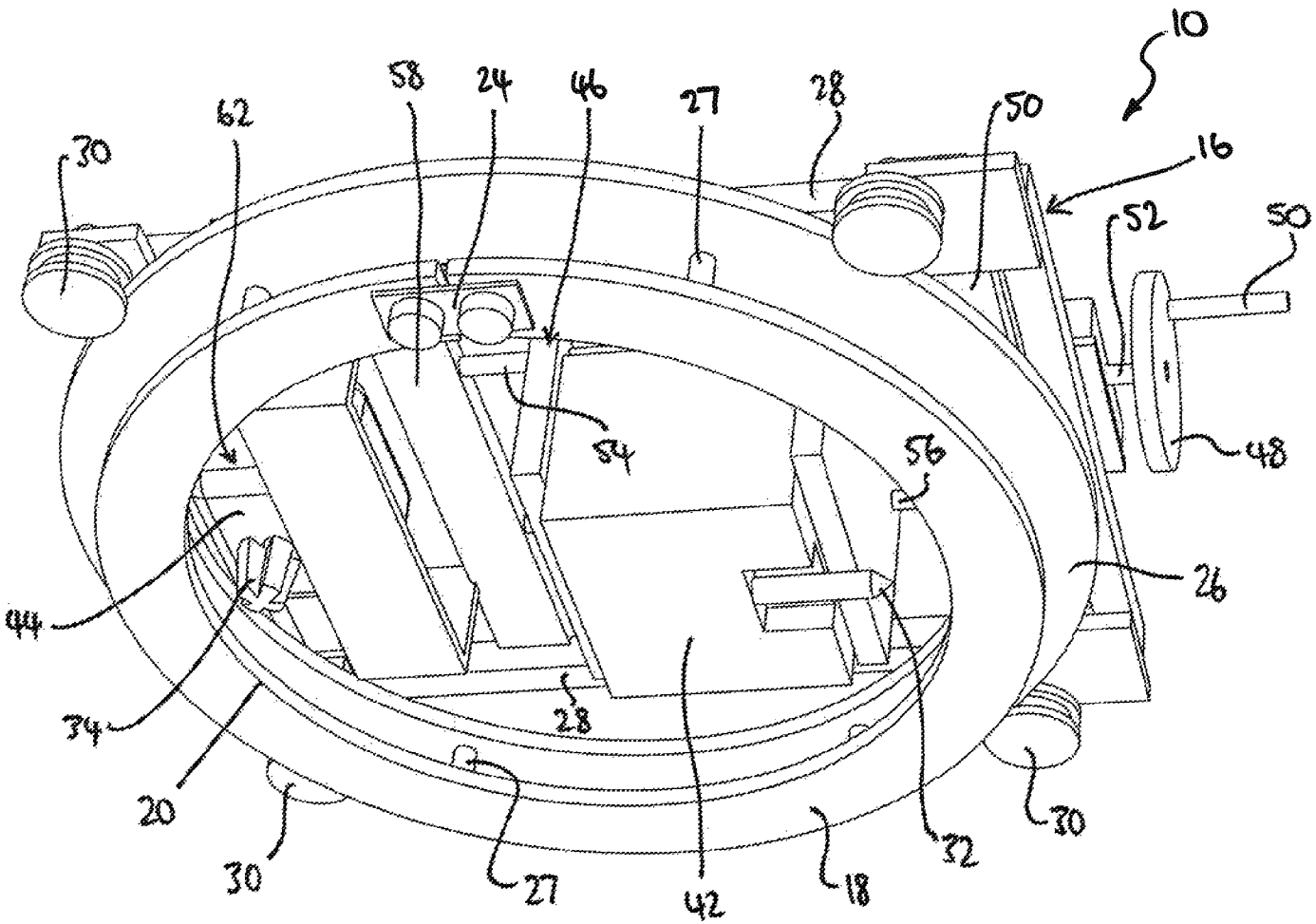
FIG. 1 illustrates a perspective view of a portable crozer in accordance with the present invention.
Figure 2:
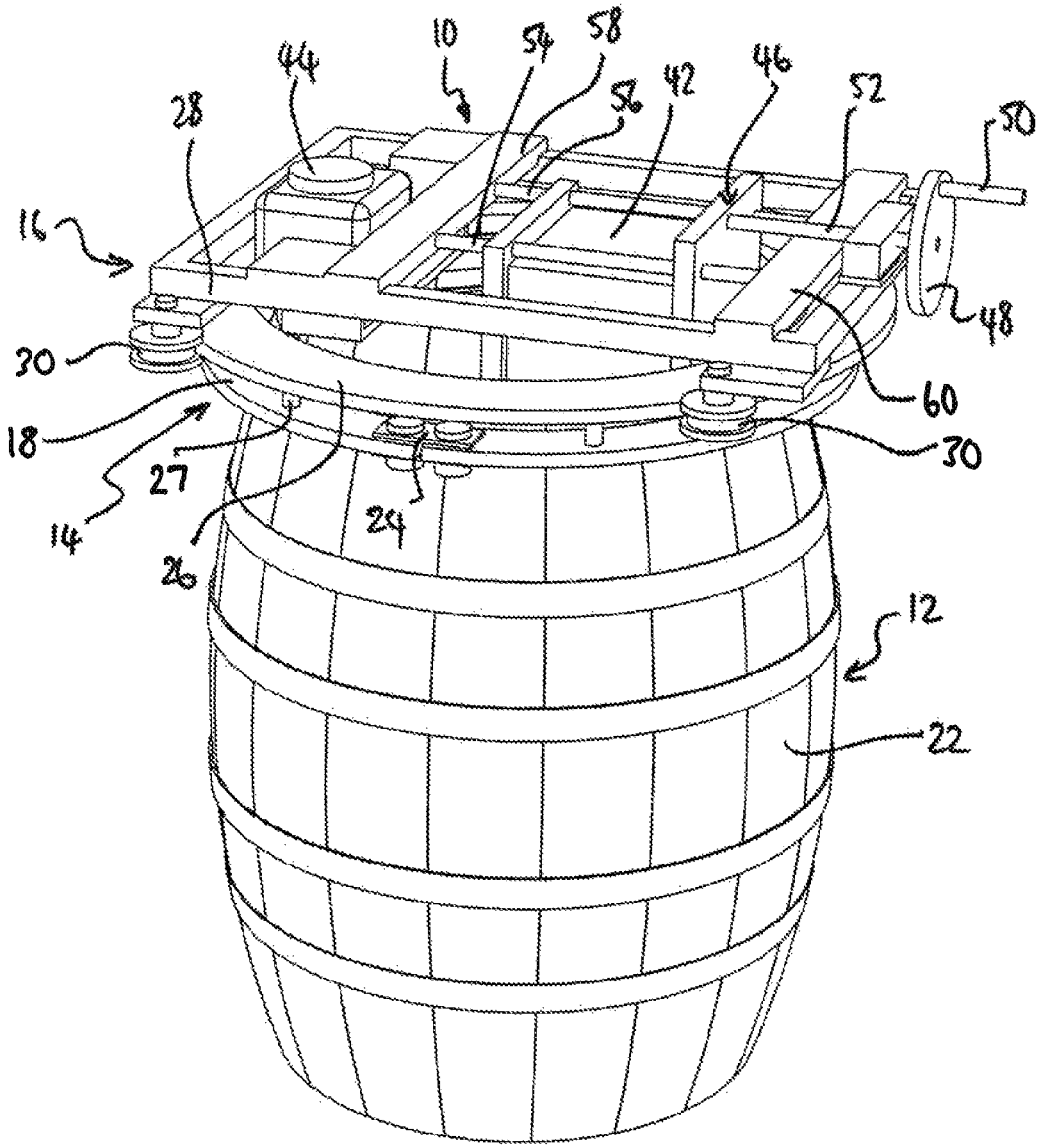
FIG. 2 illustrates a perspective view of the portable crozer of FIG. 1 when supported above a wine barrel.

The present invention relates to a portable crozer 10 for barrels 12, as shown in FIG. 1. The crozer 10 includes a mounting assembly 14 and a cutting assembly 16 rotatably supported thereabove. The mounting assembly 14 includes an annular clamp 18 adapted to rest horizontally on the upper end of a vertically standing barrel 12, as shown clearly in FIGS. 2-3, whereby an inner edge 20 of the clamp 18 abuts with the outer curved surface 22 of the barrel 12. The clamp 18 includes adjustment means 24 to accommodate barrels of different diameter. It is to be understood that the mounting portion 14 could be designed and configured differently, its important function being solely to secure the cutting apparatus 16 in place on top of the barrel 12 ready for use.

Figure 3:
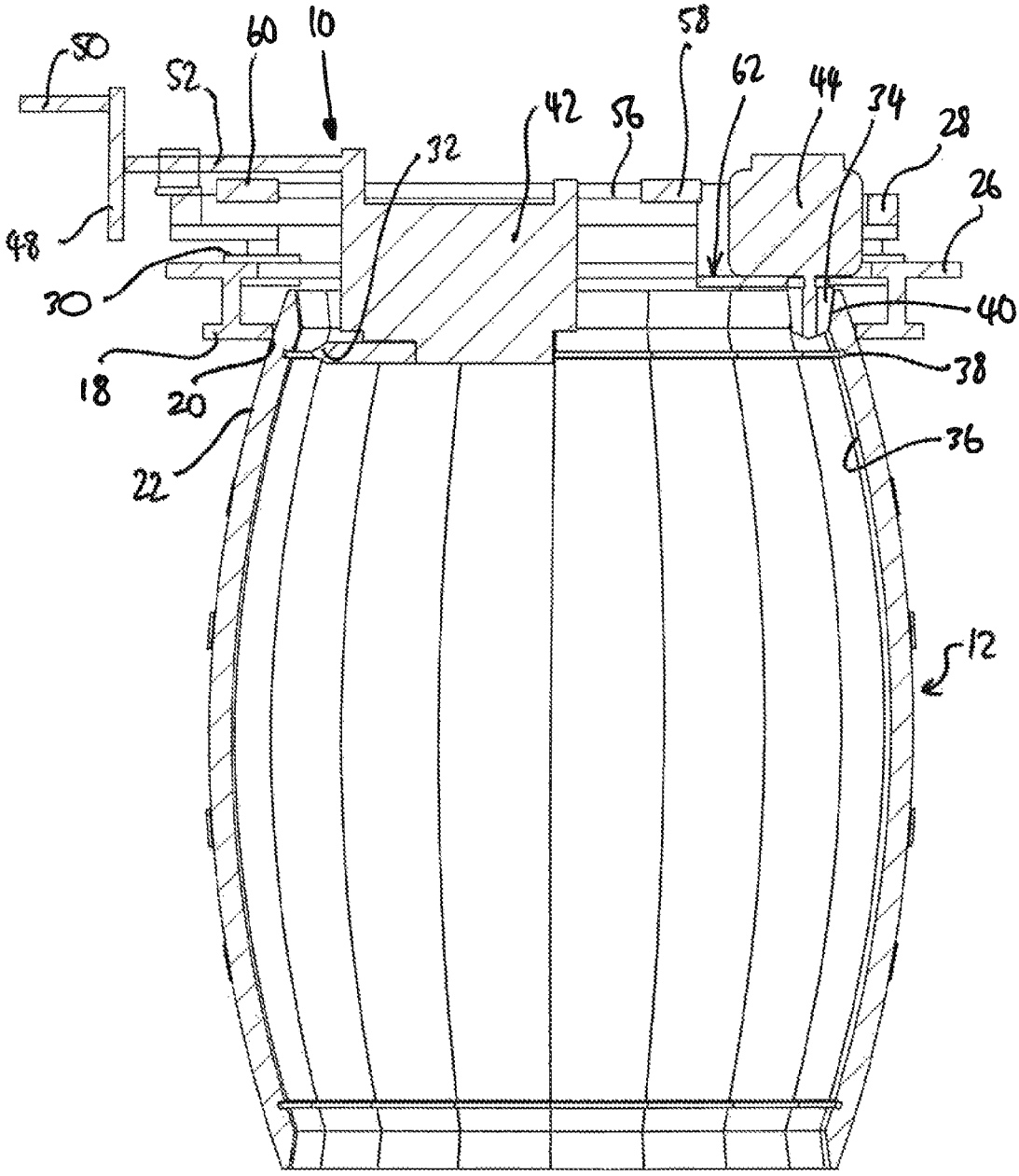
FIG. 3 illustrates a side cross sectional view of the portable crozer and barrel of FIG. 2.

The mounting assembly 14 further includes an annular guide 26 disposed a short distance above the annular clamp 18 by support rods 27, the guide 26 being of a larger diameter to that of the clamp 18. The diameter of the clamp 18 should be adjusted so that the guide 26 sits just above the top of the barrel as shown in FIG. 3. This ensures the cutting assembly 16 is at correct alignment inside the barrel 12 to perform the cutting operations, as described below.

The cutting assembly 16 is mounted to a substantially rectangular frame 28 having four rollers 30 suspended from the frame 28 in a radially disposed arrangement, to slideably engage the annular guide 26. Those skilled in the art would realise that such a configuration allows for rotational motion of the frame 28 and hence the cutting assembly 16, relative to the mounting assembly 12 which remains fixed to the barrel 12.

The rollers 30 could be electrically driven, in which case rotation of the frame 28 could be electrically controlled. For example, an associated switch (not shown) could be mounted to the frame which when pressed activates movement of the frame 28. In such circumstances, it is envisaged that there would also be safety measures installed, for example, emergency stop switches and the like. In the embodiment shown however, the frame is manually rotatable preferably using handle bars (not shown) mounted to the frame 28.

Figure 4:
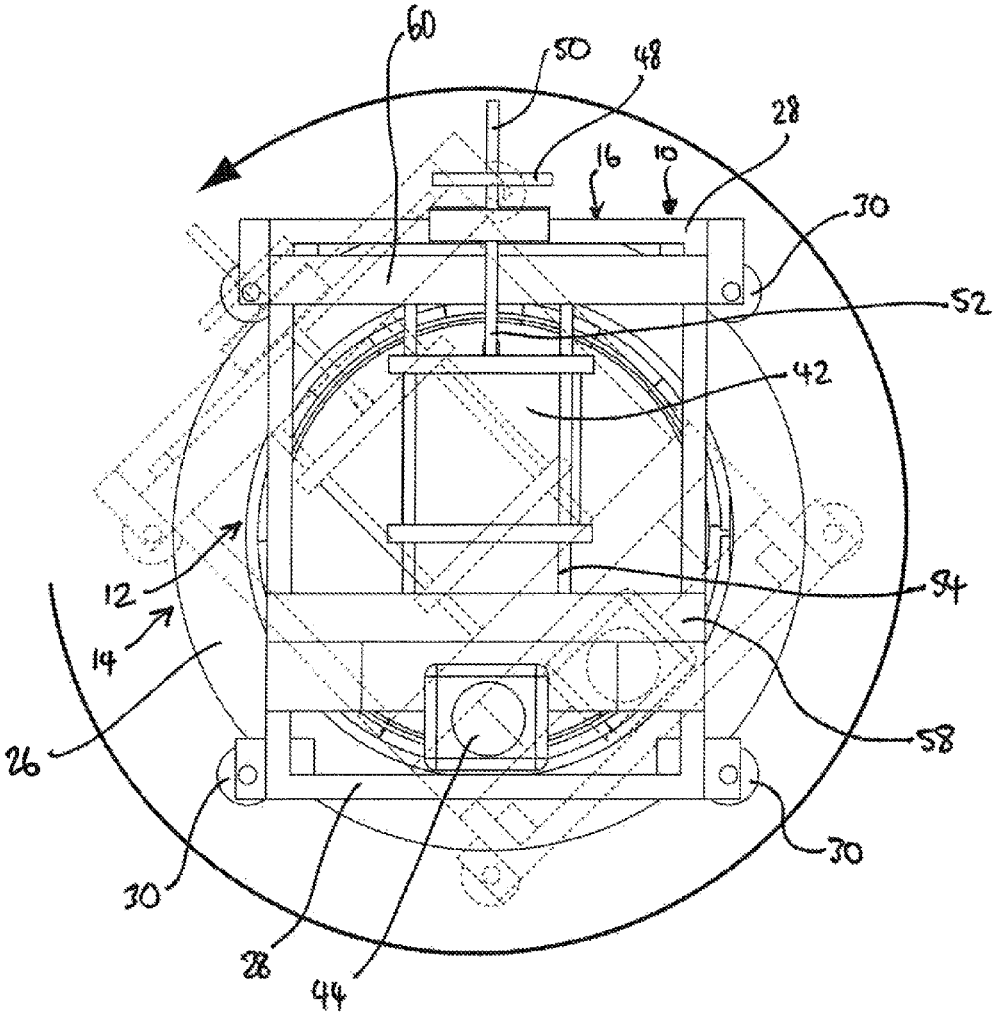
FIG. 4 illustrates a top view of the portable crozer and barrel of FIG. 2 and, in particular, the way in which the upper frame and cutting means is rotatable about the barrel.

The cutting assembly 16 comprises two separate cutting means 32 and 34, the first being an outwardly extending pointed blade 32 which when brought into contact with the inside surface 36 of the barrel 12 forms a croze 38 therealong, and the second being a downwardly extending router 34 adapted to create a bevelled edge 40 above the croze. The pointed blade 32 is conical in shape and terminates in a contact point, while the router 34 also terminates in a point but includes diagonal contact edges, as clearly shown in FIG. 3. Those skilled in the art would realise that each croze and bevel is to extend around the entire inside surface of the barrel, and this is achieved by rotating the frame 28 around the circular guide 26 through one or more revolutions. Rotational movement of the frame 28 is shown in FIG. 4. Each cutting means 32 and 34 is driven by a separate power source, in this embodiment being respective electric motors 42 and 44.

The cutting operations are made sequentially, that is, blade 32 is adapted to be used in a first pass to create the croze 38, and blade 34 is adapted to be subsequently used in a second pass to create the bevelled edge 40. The skilled addressee would realise that the cutting blades therefore need to be moveable between working and non-working positions, and vice versa.

Figure 5:
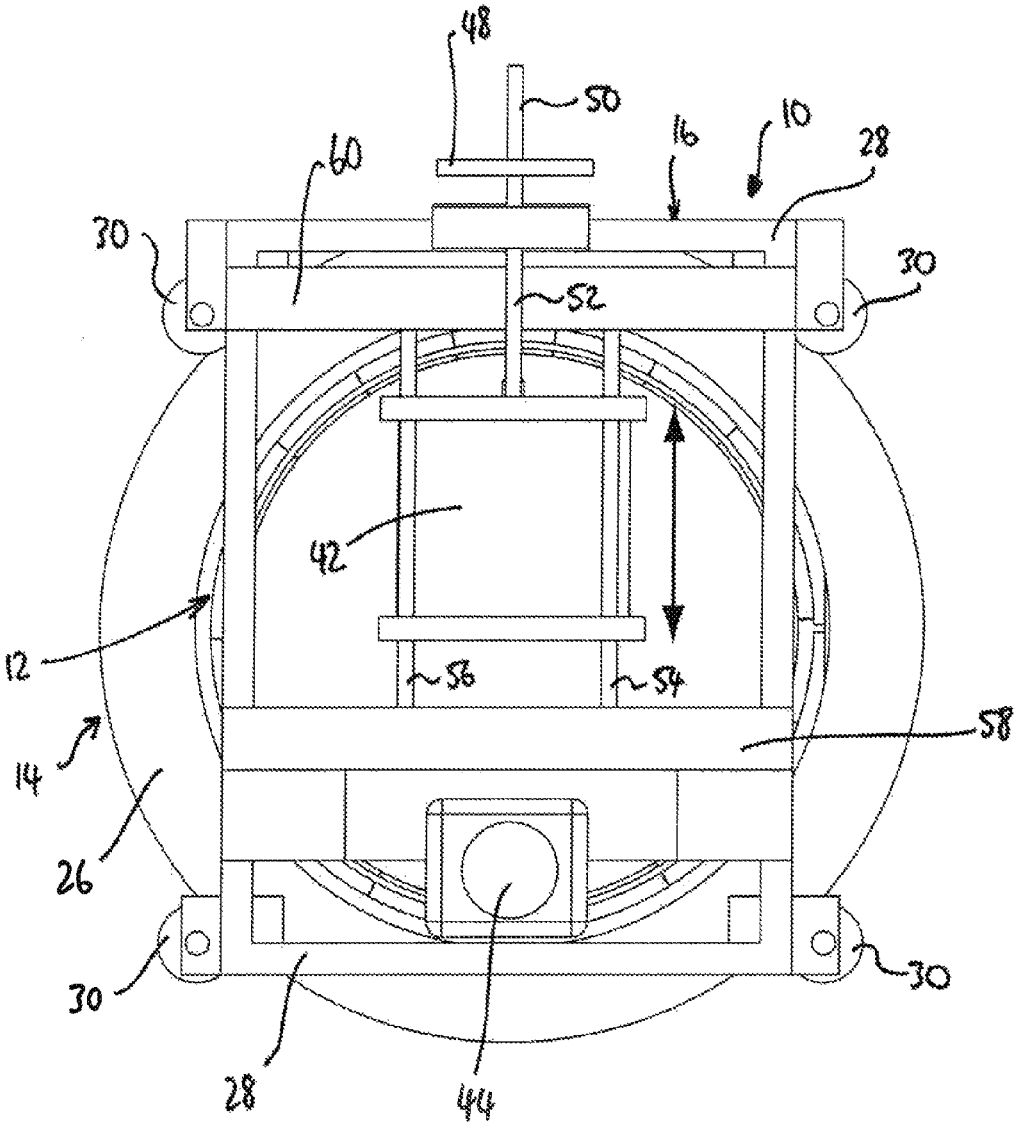
FIG. 5 illustrates a top view of the portable crozer and barrel of FIG. 2 and, in particular, the way in which the crozing blade is horizontally adjustable.

The pointed blade 32 and its associated motor 42 are supported within a sub-frame 46, horizontally moveable by rotation of a spindle 48 using handle 50 as shown in FIG. 5. This is achieved by way of threaded engagement between a shaft 52 associated with the spindle 48, and the sub-frame 46. More particularly, clockwise rotation of the spindle 48 moves the pointed blade 32 outwardly, closer to the inside surface 36 of the barrel 12, and anticlockwise rotation moves the pointed blade 32 inwardly, away from the inside surface 36. In an alternate configuration, clockwise rotation of the spindle 48 could move the blade 32 inwardly, and anticlockwise rotation could move the blade 32 outwardly.

Horizontal movement of the sub-frame 46 is aided by two guide shafts 54 and 56 which extend between cross members 58 and 60 associated with frame 28. The sub-frame 46 slideably engages the guide shafts 54 and 56 during movement caused by rotation of the spindle 48. It is to be understood that the spindle may have associated therewith visual indicia which indicates the position of the sub-frame 46 relative to a start position. For example, if a groove of say 5 mm is required, one could rotate the spindle until such a reading is displayed on the visual indicia.

Although not shown, the sub-frame 46 and hence the pointed blade 32 is also adapted to be vertically moveable with respect to the mounting assembly 14. This could be achieved by any known adjustment means, for example, by way of rotational threaded engagement between a further spindle (not shown) and the sub-frame 46. A further adjustment means could be by way of engagement between a biased locking member and any one of a plurality of vertically disposed locking grooves (not shown) located on the sub-frame 46, each groove specifying a predetermined height. Vertical and horizontal movement of the sub-frame 46 could equally well be electrically controlled.

The position of the router 34 is also adapted to be vertically and horizontally moveable. For example, although not shown, the threaded shaft 52 associated with the spindle 48 could extend to a sub-frame 62 housing the router 34 and associated motor 44. A moveable clutch arrangement (not shown) could be used whereby when the clutch is in one position, rotation of the spindle 48 causes movement of sub-frame 46, and when in a second position, rotation of the spindle 48 causes movement of sub-frame 62. Again, other adjustment means could be used, for example, vertical and horizontal movement of sub-frame 62 could equally well be electrically controlled.

Although the portable crozer 10 of the present invention can be used in crozing and bevelling new barrels, it is particularly suited for use in reconditioning used barrels. For example, just after the inside surface of a used barrel has been shaved, a new croze and bevelled edge is required. Those skilled in the art would realise that following shaving and re-crozing, a reconditioned barrel would in fact hold approximately the same volume of liquid as a new barrel, given that even though material has been removed from the inside walls of the barrel, the distance between barrel heads has been shortened.

The benefits of the present invention should now be realised. The crozer 10 of the present invention is adapted to be mounted above a new or used barrel for firstly creating a groove or "croze" along an inside surface to accommodate a barrel head, and secondly, for creating a bevelled top edge. In the case of used barrels, the croze is formed a short distance below the existing croze, and a new bevelled edge is formed to compensate for the lowered barrel head position. Conventional crozers are not adapted to be used on used barrels and have a number of inherent problems which are overcome by the present invention. In particular, conventional crozers are not portable which means they are not able to be used in mobile barrel reconditioning services, the time taken for each croze is significant, and they are generally in the form of bulky, quite expensive machinery.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. A portable crozer for barrels including:

a mounting means for securing said portable crozer onto an upper end of said barrel such that said crozer sits substantially horizontally thereabove, said mounting means including an annular clamp adapted to contact and rest upon an outer surface of said barrel adjacent the upper end, said clamp being adjustable to accommodate different barrel diameters;

at least a first cutting means rotatably associated with said mounting means, said cutting means adapted to extend partially inside the barrel end when said mounting means is secured and configured such that the relative distance between the cutting means and an inside surface of said barrel is adjustable, the cutting means further being rotatable to form an annular groove along the inside surface of said barrel adjacent the end, said groove adapted to accommodate a barrel head.

2. A portable crozer as in claim 1 wherein said crozer includes a second cutting means adapted to extend partially inside the barrel end when said mounting means is secured and configured such that the relative distance between the second cutting means and an inside surface of said barrel is adjustable, the second cutting means further being to form an inwardly extending bevel along an edge of the barrel end.

3. A portable crozer as in claim 2 wherein said second cutting means is in the form of a downwardly extending router which when brought into contact with the inside edge of the barrel end, forms said bevel.

4. A portable crozer as in claim 3 wherein the horizontal and vertical position of said router is adjustable.

5. A portable crozer as in claim 4 wherein said router is powered by a driving means for rotating the router.

6. A portable crozer as in claim 5 wherein said driving means is an electric motor.

7. A portable crozer as in claim 2 wherein said first and second cutting means are mounted to a supporting frame which rotatably engages the crozer mounting means.

8. A portable crozer as in claim 1 wherein said annular clamp includes an annular guide disposed thereabove, said annular guide extending in a parallel arrangement with said clamp.

9. A portable crozer as in claim 8 wherein said supporting frame includes a plurality of radially disposed rollers adapted to slideably engage the annular guide.

10. A portable crozer as in claim 1 wherein the upright barrel includes a central vertical axis and said first cutting means is in the form of a pointed blade extending outwardly therefrom.

11. A portable crozer as in claim 10 wherein the horizontal and vertical position of said pointed blade is adjustable to thereby allow for the height and depth of the internal groove to be selected.

12. A portable crozer as in claim 10 wherein the horizontal position of the outwardly extending pointed blade relative to the inner barrel surface is adjustable by rotation of a spindle having a shaft associated therewith in threaded engagement with a moveable sub-frame which supports said pointed blade.

13. A portable crozer as in claim 12 wherein said sub-frame also supports a driving means for driving the pointed blade.

14. A portable crozer as in claim 13 wherein said driving means is an electric motor.

15. A portable crozer adapted to form a croze on an inside edge of a barrel adjacent its end for accommodating a barrel head, said portable crozer including:

a mounting assembly comprising an annular clamp of a diameter such that said clamp is adapted to contact and rest above an outer surface of the upper end of an upright barrel, said clamp further being adjustable to accommodate different barrel diameters, said mounting assembly further including an annular guide disposed above said barrel end; a support frame assembly including a plurality of rollers suspended therefrom each being rotatable about a vertical axis and adapted to slideably engage the annular guide to facilitate rotation of the support frame relative to said mounting assembly; and a crozer blade supported by and moveable with said support frame, said crozer blade extending at least partially inside the upper barrel end once the mounting assembly is secured and configured such that the relative distance between the crozer blade and the inside edge of the barrel is adjustable, the crozer blade adapted to be moved towards the inner surface of the barrel during rotation of the support frame to effect formation of the croze.

16. A portable crozer as in claim 15 further including a downwardly extending router supported by and moveable with said support frame, said router extending at least partially inside the upper barrel end once the mounting assembly is secured and configured such that the relative distance between the router and the inside edge of the barrel is adjustable, the router adapted to be moved towards the inner surface of the barrel during rotation of the support frame to effect formation of a bevel along an internal edge of the barrel end.

17. A portable crozer adapted to form a croze on an inside edge of a barrel adjacent its end for accommodating a barrel head, said portable crozer including:

a mounting assembly comprising an annular clamp of a diameter such that said clamp is adapted to contact and rest above an outer surface of the upper end of an upright barrel, said clamp further being adjustable to accommodate different barrel diameters, said mounting assembly further including an annular guide disposed above said barrel end;

a support frame assembly including a plurality of rollers suspended therefrom each being rotatable about a vertical axis and adapted to slideably engage the annular guide to facilitate rotation of the support frame relative to said mounting assembly; a crozer blade supported by and moveable with said support frame, said crozer blade extending at least partially inside the upper barrel end once the mounting assembly is secured and configured such that the relative distance between the crozer blade and the inside edge of the barrel is adjustable, the crozer blade adapted to be moved towards the inner surface of the barrel during rotation of the support frame to effect formation of the croze; and a downwardly extending router supported by and moveable with said support frame, said router extending at least partially inside the upper barrel end once the mounting assembly is secured and configured such that the relative distance between the router and the inside edge of the barrel is adjustable, the router adapted to be moved towards the inner surface of the barrel during rotation of the support frame to effect formation of a bevel along an internal edge of the barrel end.

* * * * *